US008624698B2

(12) United States Patent
Kim et al.

(10) Patent No.: US 8,624,698 B2
(45) Date of Patent: Jan. 7, 2014

(54) TRANSFORMER AND POWER MODULE HAVING THE SAME

(75) Inventors: Deuk Hoon Kim, Gyunggi-do (KR); Dae Young Hwang, Gyunggi-do (KR); Myeong Jeong Kim, Gyunggi-do (KR); Jong Woo Kim, Gyunggi-do (KR); Chang Yong Kwon, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 0 days.

(21) Appl. No.: 13/533,596

(22) Filed: Jun. 26, 2012

(65) Prior Publication Data

US 2013/0169400 A1 Jul. 4, 2013

(30) Foreign Application Priority Data

Dec. 28, 2011 (KR) ..... 10-2011-0144221

(51) Int. Cl.
*H01F 27/30* (2006.01)
*H01F 27/29* (2006.01)

(52) U.S. Cl.
USPC ..... 336/198; 336/192; 336/196; 336/199

(58) Field of Classification Search
USPC ..... 336/192, 196, 198, 199, 207, 208
See application file for complete search history.

(56) References Cited

U.S. PATENT DOCUMENTS

| | | | | |
|---|---|---|---|---|
| 2,872,653 | A * | 2/1959 | Wiegand | 336/221 |
| 3,845,913 | A * | 11/1974 | Hagen | 242/476.2 |
| 4,091,349 | A * | 5/1978 | Niederjohn et al. | 336/192 |
| 4,352,079 | A * | 9/1982 | Mueller et al. | 336/65 |
| 4,569,345 | A * | 2/1986 | Manes | 606/38 |
| 5,359,313 | A * | 10/1994 | Watanabe et al. | 336/178 |
| 6,201,463 | B1 * | 3/2001 | Yamashita et al. | 336/198 |
| 6,587,023 | B2 * | 7/2003 | Miyazaki et al. | 336/83 |
| 6,853,289 | B2 * | 2/2005 | Scoggin | 337/194 |
| 7,579,936 | B2 * | 8/2009 | Hsu et al. | 336/178 |
| 7,834,733 | B2 * | 11/2010 | Feist et al. | 336/198 |
| 8,183,968 | B2 * | 5/2012 | Tsai et al. | 336/198 |

FOREIGN PATENT DOCUMENTS

JP 6-9117 U 2/1994

* cited by examiner

*Primary Examiner* — Alexander Talpalatski
*Assistant Examiner* — Joselito Baisa
(74) *Attorney, Agent, or Firm* — McDermott Will & Emery LLP

(57) ABSTRACT

A transformer capable of security insulting reliability and a power module having the same are provided. The transformer includes: a winding unit having at least one winding space in which a plurality of coils are wound in a stacked manner on an outer circumferential surface of a cylindrical body portion; and a terminal fastening unit formed to extend from one end of the winding unit in an outer diameter direction and having a plurality of external connection terminals fastened to an end thereof, wherein a width of the winding space is less than 0.45 times that of a diameter of the body portion.

15 Claims, 9 Drawing Sheets

A-A'

D-D'

TRANSFORMER AND POWER MODULE HAVING THE SAME

CROSS-REFERENCE TO RELATED APPLICATIONS

This application claims the priority of Korean Patent Application No. 10-2011-0144221 filed on Dec. 28, 2011, in the Korean Intellectual Property Office, the disclosure of which is incorporated herein by reference.

BACKGROUND OF THE INVENTION

1. Field of the Invention

The present invention relates to a transformer and to a power module having the same and, more particularly, to a transformer capable of securing insulating reliability and a power module having the same.

2. Description of the Related Art

Various kinds of power supplies are required in various electronic devices such as a TV (Television), a monitor, a personal computer (PC), an office automation (OA) device, and the like. Therefore, these electronic devices generally include power supplies converting alternating current (AC) power supplied from the outside into power having an appropriate level for individual electronic appliances.

Recently, among power supply devices, a power supply device using a switching mode (e.g., a switched mode power supply (SMPS)) has been commonly used, and such an SMPS generally includes a switching transformer.

In general, a switching transformer converts AC power of 85V-265V into DC power of 3V-30V by high frequency oscillations of 25 KHz-100 KHz. Thus, in comparison to a general transformer which converts AC power of 85V-265V into AC power of 3V-30V by frequency oscillations of 50 Hz-60 Hz, the size of a core and a bobbin of a switching transformer can be significantly reduced, and since a switching transformer stably supplies DC power having low voltage and low current to electronic application devices, a switching transformer is extensively used in electronic application devices, the trend of which is reductions in size.

A switching transformer may have high energy conversion efficiency when designed to have low leakage inductance. However, as the size of a switching transformer is reduced, it may be difficult to design a switching transformer having low leakage inductance.

Also, when a compact transformer is fabricated, a primary coil and a secondary coil are disposed to be significantly adjacent, making it difficult to secure (or ensure) insulating reliability therebetween.

PRIOR ART DOCUMENT

Patent Document (Patent document 1) Japanese Patent Laid Open Publication No. 1994-009117

SUMMARY OF THE INVENTION

An aspect of the present invention provides a compact switching transformer and a power module having the same.

Another aspect of the present invention provides a transformer capable of minimizing leakage inductance and a power module having the same.

Another aspect of the present invention provides a transformer capable of securing insulating reliability between a primary coil and a secondary coil, and a power module having the same.

According to an aspect of the present invention, there is provided a transformer including: a winding unit having at least one winding space in which a plurality of coils are wound in a stacked manner on an outer circumferential surface of a cylindrical body portion; and a terminal fastening unit formed to extend from one end of the winding unit in an outer diameter direction and having a plurality of external connection terminals fastened to an end thereof, wherein a width of the winding space is less than 0.45 times a diameter of the body portion.

The winding space of the winding unit may be divided into a plurality of partitioned winding spaces by at least one partition wall formed on the outer circumferential surface of the body portion, and the partitioned winding spaces may have a width equal to 0.45 times the diameter of the body portion, respectively.

A total width of the partitioned winding spaces of the winding unit may be less than or equal to 0.57 times the diameter of the body portion.

A length of the body portion may be less than or equal to 0.57 times the diameter of the body portion.

The partition wall may have at least one skip groove, and the coils may skip the partition wall via the skip groove so as to be evenly wound in the respective winding spaces.

At least two skip grooves may be formed to be spaced apart from one another, and the coils may pass over or pass through the different skip grooves according to their order, respectively.

The terminal fastening unit may have at least one withdrawal opening, and the coils may be led out to a lower side of the terminal fastening unit through the withdrawal opening.

At least two withdrawal openings may be formed to be spaced apart from one another, and the coils may be led out through the different withdrawal openings according to their order, respectively.

The terminal fastening unit may include at least one catching groove formed in a direction in which the coils wound in the winding space are led out, and lead wires of the coils may be led out by traversing the catching groove in a length direction of the stopping opening.

The catching groove may be formed in a tangent direction with respect to an outer surface formed by the coils wound in the winding space.

The lead wires led out to the terminal fastening unit may be led out in the tangent direction with respect to the outer surface formed by the coils wound in the winding space.

The coils may include a primary coil and a secondary coil wound in a stacked manner, and when the primary coil and the secondary coil are in contact within the winding space, an intersecting angle between the primary coil and the secondary coil may be less than 45°.

At least one of the primary coil and the secondary coil may be a multi-insulated coil.

According to another aspect of the present invention, there is provided a transformer including: at least one winding space formed by a cylindrical body portion and flange portions formed at both ends thereof; and a plurality of coils wound in a stacked manner in the winding space, wherein a size of the winding space satisfies a conditional expression below:

$$T_s \leq 0.45 W_b \quad \text{(Conditional expression)}$$

wherein $T_s$ is a width of the winding space and $W_b$ is a diameter of the body portion.

According to another aspect of the present invention, there is provided a transformer including: a plurality of partitioned winding spaces formed by a cylindrical body portion and flange portions formed at both ends thereof; and a plurality of coils wound in a stacked manner in the winding spaces, wherein a size of the partitioned winding spaces satisfies a conditional expression below:

$$T_a \leq 0.57 W_b \quad \text{(Conditional expression)}$$

wherein $T_a$ is a width of the entire winding space and $W_b$ is a diameter of the body portion.

The size of each of the partitioned winding spaces may satisfy a conditional expression below:

$$T_s \leq 0.45 W_b \quad \text{(Conditional expression)}$$

wherein $T_s$ is a width of each winding space and $W_b$ is a diameter of the body portion.

According to another aspect of the present invention, there is provided a transformer including: at least one winding space formed by a cylindrical body portion and flange portions formed at both ends thereof; and a plurality of coils wound in a stacked manner in the winding space, wherein a size of the winding space satisfies a conditional expression below:

$$T_s \leq 0.4R \quad \text{(Conditional expression)}$$

wherein, $T_s$ is a width of the winding space, and R is a diameter formed by an outer circumferential surface of the coil wound at the innermost portion of the body portion.

According to another aspect of the present invention, there is provided a transformer including: a cylindrical body portion; and coils including at least one primary coil and at least one secondary coil wound around the body portion in a stacked manner, wherein the coils are formed such that a winding diameter thereof is less than 0.45 times a diameter of the body portion.

According to another aspect of the present invention, there is provided a transformer including: a cylindrical body portion; and coils including at least one primary coil and at least one secondary coil dividedly disposed in a plurality of spaces and wound around the body portion in a stacked manner, wherein the coils are formed such that an entire winding diameter thereof is less than 0.57 times a diameter of the body portion.

According to another aspect of the present invention, there is provided a transformer including: a cylindrical body portion; and coils including at least one primary coil and at least one secondary coil wound around the body portion in a stacked manner, wherein the coils are formed such that a winding diameter thereof is less than 0.4 times a diameter formed by an outer circumferential surface of the coil wound at the innermost portion of the body portion.

According to another aspect of the present invention, there is provided a power module including: a transformer in which coils are wound in a stacked manner in at least one winding space formed by a cylindrical body portion and flange portions formed at both ends thereof; and a substrate on which the transformer is mounted, wherein a width of the at least one winding space is less than 0.45 times a diameter of the body portion.

According to another aspect of the present invention, there is provided a power module including: a transformer in which coils are wound in a stacked manner in at least one winding space formed by a cylindrical body portion and flange portions formed at both ends thereof; and a substrate on which the transformer is mounted, wherein a total width of the partitioned winding spaces is less than 0.57 times a diameter of the body portion.

According to another aspect of the present invention, there is provided a power module including: a transformer in which coils are wound in a stacked manner in at least one winding space formed by a cylindrical body portion and flange portions formed at both ends thereof; and a substrate on which the transformer is mounted, wherein a width of the at least one winding space is less than 0.4 times a diameter formed by an outer circumferential surface of the coil wound at the innermost portion of the body portion.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
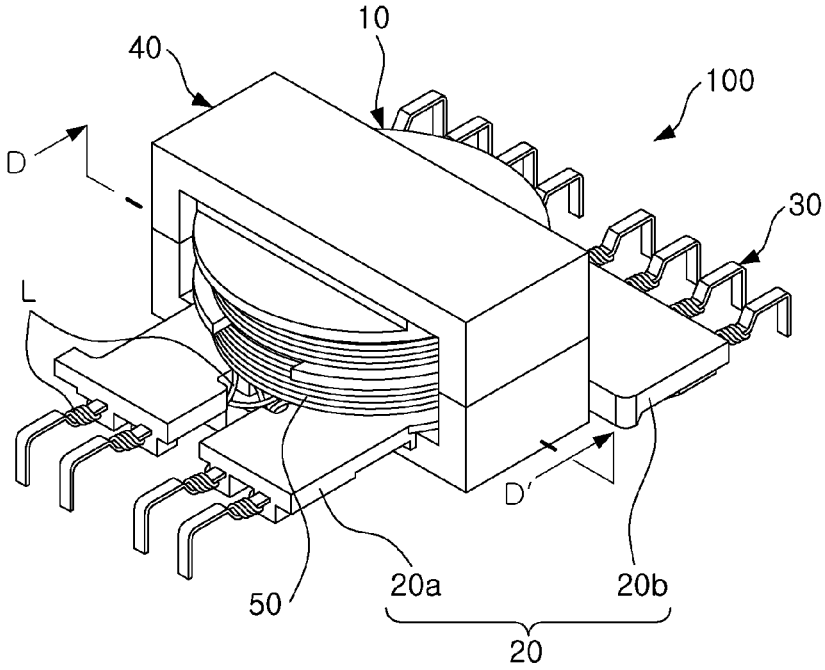
FIG. 1 is a perspective view schematically illustrating a transformer according to an embodiment of the present invention.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

Embodiments of the present invention will be described in detail with reference to the accompanying drawings.

Figure 2A:
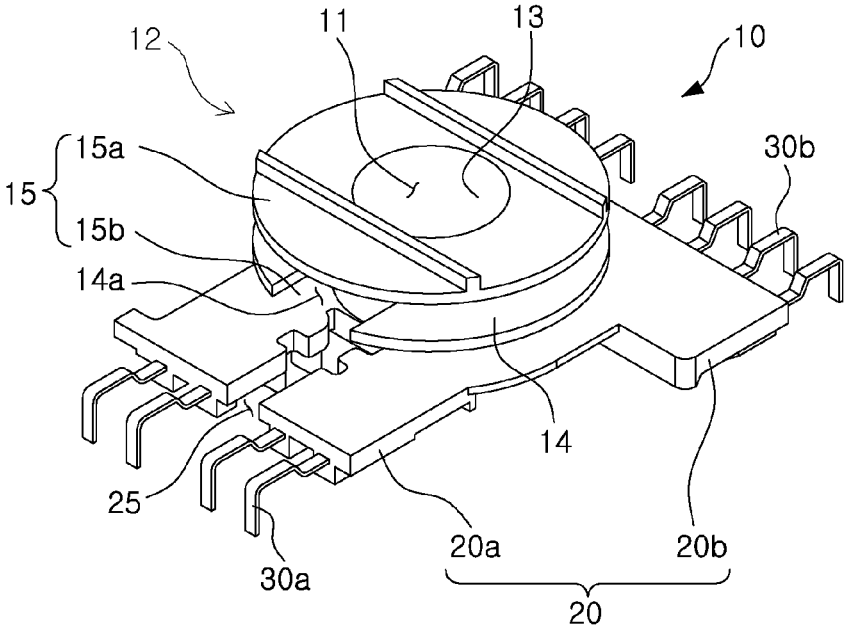
FIG. 2A is a perspective view schematically illustrating a bobbin of the transformer illustrated in FIG. 1.
Figure 2B:
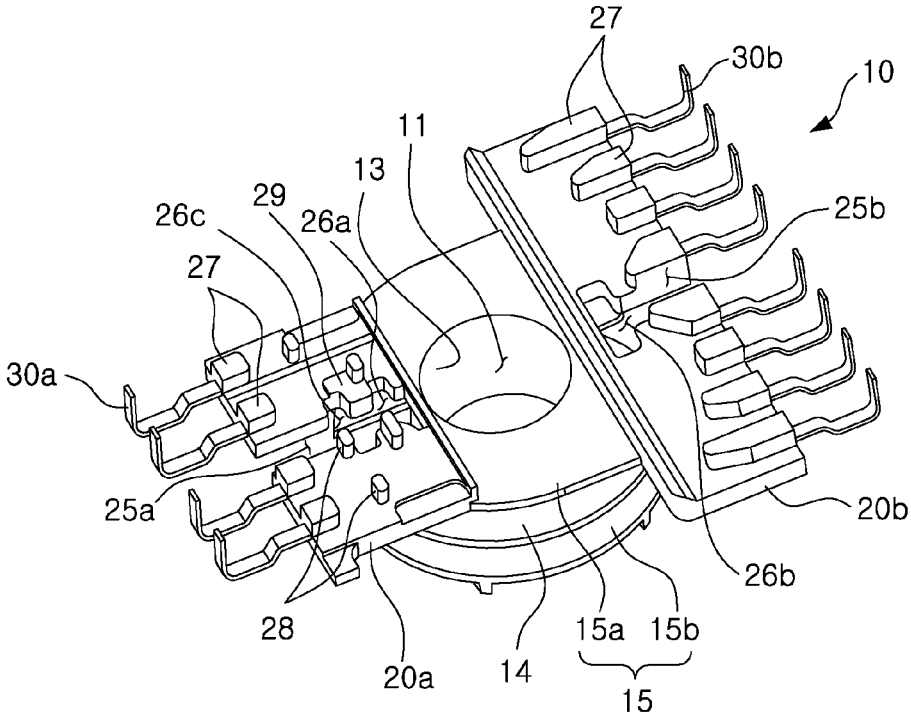
FIG. 2B is a bottom perspective view schematically illustrating the bobbin illustrated in FIG. 2A.
Figure 3A:
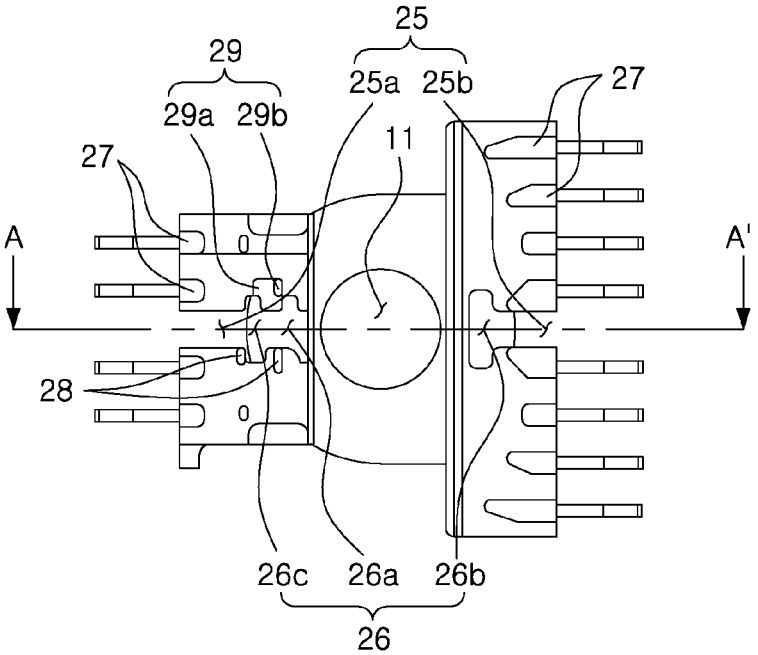
FIG. 3A is a bottom view of the bobbin illustrated in FIG. 2A.
Figure 3B:
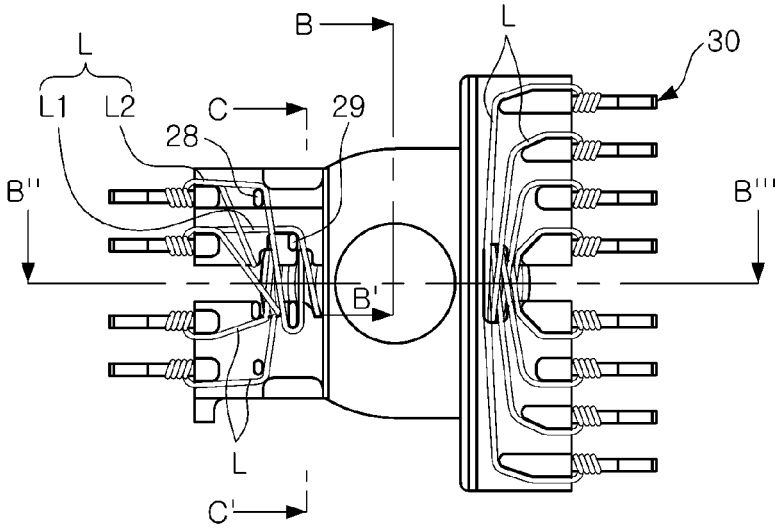
FIG. 3B is a bottom view illustrating a state in which coil is wound around the bobbin illustrated in FIG. 3A.
Figure 4A:
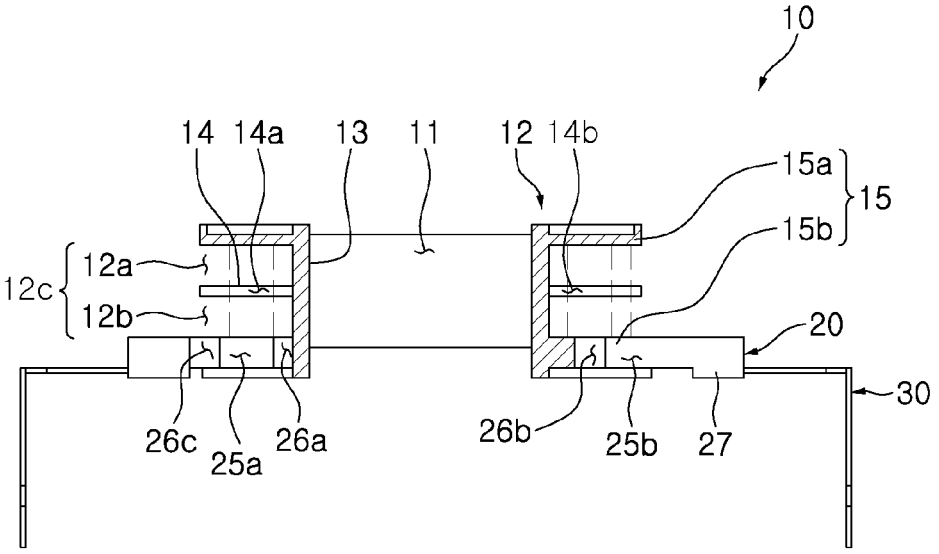
FIG. 4A is a cross-sectional view taken along line A-A' in FIG. 3A.
Figure 4B:
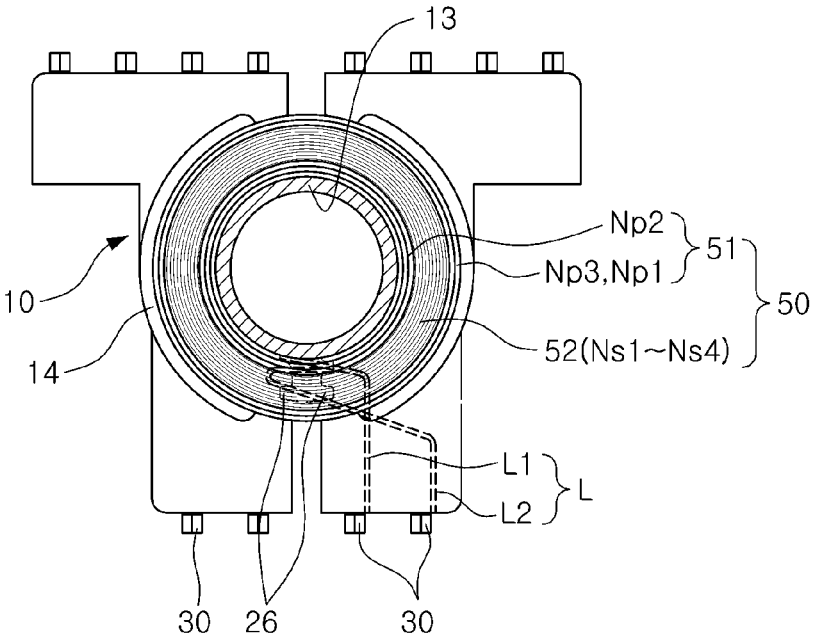
FIG. 4B is a intersect-sectional view taken along line D-D' in FIG. 1B.

FIG. 1 is a perspective view schematically illustrating a transformer according to an embodiment of the present invention. FIG. 2A is a perspective view schematically illustrating a bobbin of the transformer illustrated in FIG. 1. FIG. 2B is a bottom perspective view schematically illustrating the bobbin illustrated in FIG. 2A;

FIG. 3A is a bottom view of the bobbin illustrated in FIG. 2A. FIG. 3B is a bottom view illustrating a state in which coil is wound around the bobbin illustrated in FIG. 3A. FIG. 4A is a cross-sectional view taken along line A-A' in FIG. 3A. FIG. 4B is a cross-sectional view taken along line D-D' in FIG. 1B. Here, in FIG. 4B, a core is omitted for the sake of explanation.

With reference to FIGS. 1 through 4B, a transformer 100 according to an embodiment of the present invention is an insulation type switching transformer including a bobbin 10, a core 40, and a coil 50.

The bobbin 10 includes a winding unit 12 around which the coil 50 is wound, and a terminal fastening unit 20 formed at one end of the winding unit 12.

The winding unit 12 may include a body portion 13 having a cylindrical shape and a flange portion 15 extending from both ends thereof 13 in a outer diameter direction.

A through hole 11 is formed within the body portion to allow a portion of the core 40 to be inserted thereinto, and at least one partition wall 14 may be formed on an outer circumferential surface of the body portion 13 to partition space in a length direction of the body portion 13. Here, the coil 50 may be wound in each space partitioned by the partition wall 14.

The winding unit 12 according to the present embodiment includes a single partition wall 14. Thus, the winding unit 12 according to the present embodiment includes two partitioned spaces 12*a* and 12*b*. However, the present invention is not limited thereto and varying amounts of spaces may be formed by varying amounts of partition walls 14 and used as necessary.

Also, the partition wall 14 according to the present embodiment includes at least one skip groove 14*a* allowing the coil 50 wound in a particular space (e.g., an upper winding space 12*a*) to skip the partition wall 12 so as to be wound in an adjacent different space (e.g., a lower winding space 12*b*).

The skip groove 14*a* may be formed by completely removing a portion of the partition wall 14 such that an outer surface of the body portion 13 is exposed. Also, a width of the skip grooves 14*a* and 14*b* may be greater than a thickness (i.e., a diameter) of the coil 50.

Two skip grooves 14*a* and 14*b* may be formed to correspond to positions of the terminal fastening units 20*a* and 20*b*. In detail, as shown in FIG. 4A, the skip grooves 14*a* and 14*b* include a first skip groove 14*a* allowing a primary coil to be led out therethrough and a second skip groove 14*b* allowing a secondary coil to be led out therethrough. Namely, in the transformer according to the present embodiment, the primary coil and the secondary coil are led out through the different skip grooves 14*a* and 14*b*.

When the primary coil and the secondary coil are led out through the same skip grooves 14*a* and 14*b*, the primary coil and the second coil may be in contact in an intersecting manner within the skip grooves 14*a* and 14*b*.

As illustrated in FIG. 4B, in the transformer 100 according to the present embodiment, an insulating member is not interposed between the primary coil 51 and the secondary coil 52. Thus, when the primary coil 51 and the secondary coil 52 are in contact under tension, the primary coil 51 and the secondary coil 52 are required to be formed such that an intersecting angle at a contact point is less than 45° in order to secure insulating reliability.

However, in the transformer 100 according to the present embodiment, as the body portion 13 is formed extendedly, the primary coil 51 and the secondary coil 52 in contact within the skip grooves 14*a* and 14*b* are highly likely to have an intersection angle of 45° or more.

Thus, in order to avoid such a problem, the transformer 100 according to the present embodiment is configured such that the primary coil and the secondary coil are led out through different skip grooves 14*a* and 14*b*.

Meanwhile, in the present embodiment, a case in which the first skip groove 14*a* and the second skip groove 14*b* are formed at positions corresponding to withdrawal openings 25*a* (to be described to later) is taken as an example. However, the present invention is not limited thereto and a plurality of skip grooves may be formed in various positions as necessary, so long as the primary coil and the second coil can pass over or pass through different skip grooves 14*a* and 14*b*.

The partition wall 14 according to the present embodiment is provided to allow the coil 50 to be substantially uniformly disposed within the partitioned winding spaces 12*a* and 12*b* and evenly wound therein. Namely, the partition wall 14 is provided to prevent the coil 50 wound within the entire winding space 12*c* from leaning or being inclined to one side.

Thus, if the width of the entire winding space 12*c* is very narrow or if there is no possibility in which the coil 50 is leaned or inclined to one side within the winding space 12*c*, the partition wall 14 may be omitted.

The partition wall 14 may have various thicknesses and may be made of various materials so long as the configuration thereof can be maintained. Also, in the present embodiment, a case in which the partition wall 14 and the bobbin 10 are integrally formed is taken as an example, but the present invention is not limited thereto and various applications may be implemented. For example, the partition wall 14 may be formed as a separate member and coupled to the bobbin 10.

The partition wall 14 according to the present embodiment may have the substantially same shape as that of the flange portion 15.

The flange portion 15 is protruded to extend from both ends thereof 13, namely, from upper and lower end portions of the body portion 13, in an outer diameter direction. The flange portion 15 according to the present embodiment may be classified into an upper flange portion 15*a* and a lower flange portion 15*b*, according to formation positions.

Also, a space formed between the outer circumferential surface of the body portion 13 and the upper and lower flange portions 15*a* and 15*b* form partitioned winding spaces 12*a* and 12*b* in which the coil 50 is wound. Thus, the flange portion 15 serves to support the coil 50 wound in the partitioned winding spaces 12*a* and 12*b* from both edges, protect the coil 50 against the outside, and secure insulating characteristics between the outside and the coil 50.

The terminal fastening unit 20 may be formed on the lower flange portion 15*b*. In detail, the terminal fastening unit 20 according to the present embodiment may be protruded from the lower flange portion 15*b* in an outer diameter direction in order to secure an insulating distance.

However, the present invention is not limited thereto and the terminal fastening unit 20 may be protruded in a downward direction from the lower flange portion 15*b*.

Meanwhile, with reference to the drawings, since the terminal fastening unit 20 according to the present embodiment is formed to partially extend from the lower flange portion 15*b*, it may be difficult to discriminate the terminal fastening unit 20 from the lower flange portion 15*b*. Thus, in the present embodiment, the lower flange portion 15*b* itself may be considered to be the terminal fastening unit 20.

An external connection terminal 30 (to be described later) may be fastened to the terminal fastening unit 20 such that it is protruded to the outside.

Also, the terminal fastening unit 20 may include a primary terminal fastening unit 20*a* and a secondary terminal fastening unit 20*b*.

As described above, the transformer 100 according to the present embodiment does not have an insulating member between the primary coil and the secondary coil. Thus, in order to secure insulating reliability, preferably, the primary coil and the secondary coil are disposed such that they are in contact or intersect each other at a minimum level.

To this end, the terminal fastening unit 20 of the transformer 100 according to the present embodiment is divided into the primary terminal fastening unit 20*a* and the secondary terminal fastening unit 20*b*. The primary coil is led out from the primary terminal fastening unit 20*a* and the secondary coil is led out from the secondary terminal fastening unit 20*b*, so as to be connected to corresponding external connection terminals 30, respectively.

Meanwhile, with reference to FIG. 1, in the present embodiment, a case in which the primary terminal fastening unit 20*a* and the secondary terminal fastening unit 20*b* extend from both ends of the lower flange portion 15*b* exposed to the outside of the core 40 is taken as an example. However, the present invention is not limited thereto and the primary terminal fastening unit 20*a* and the secondary terminal fastening unit 20*b* may be variably applied, as long as insulating characteristics therebetween are ensured. Namely, the primary terminal fastening unit 20*a* and the secondary terminal fastening unit 20*b* may be formed to be parallel on any step or formed at adjacent positions.

In addition, as shown in FIG. 3A, the terminal fastening unit 20 may include a withdrawal opening 25, a catching groove 26, a guide protrusion 27, and a stopping protrusion 28.

The withdrawal opening 25 is used to allow a lead wire (L in FIG. 1) of the coil 50 to be led to a lower side of the terminal fastening unit 20. To this end, the withdrawal opening 25 according to the present embodiment may be formed by completely removing portions of the terminal fastening unit 20 and the lower flange portion 15*b* such that an outer surface of the body portion 13 is exposed.

Also, the width of the withdrawal opening 25 may be greater than the thickness (i.e., the diameter) of the primary coil 51 and the secondary coil 52.

In particular, in the present embodiment, the withdrawal opening 25 is formed is formed at a position corresponding to the skip groove 14*a* of the foregoing partition wall 14. In detail, the withdrawal opening 25 may be formed at a position at which the skip groove 14*a* is projected in a downward direction.

Like the foregoing skip grooves 14*a* and 14*b*, two withdrawal openings 25 may be provided to allow the primary coil and the secondary coil to be led out therethrough, respectively.

Namely, in the present embodiment, the transformer 100 includes at least two withdrawal openings 25 in order to prevent the primary coil and the second coil from being in contact in an intersecting manner otherwise in a single withdrawal opening 25 when led out therethrough.

Thus, the two withdrawal openings 25 may be classified into a first withdrawal opening 25*a* through which the primary coil is led out and a second withdrawal opening 25*b* through which the secondary coil is led out.

Meanwhile, in the present embodiment, the case in which the withdrawal openings 25 are formed in the terminal fastening unit 20 is taken as an example, but the present invention is not limited thereto and a plurality of withdrawal openings may be formed in various positions as necessary.

The catching groove 26 is formed within the withdrawal opening 25. The catching groove 25 is formed by extending the width of the withdrawal opening 25. Namely, the catching groove 26 is formed extendedly in a traversing manner in the withdrawal opening 25 and has a width allowing the coil 50 to pass therethrough so as to be led out.

Also, the catching groove 26 may be formed by removing both lateral portions of the withdrawal opening 25 in a width direction or may be formed by removing only one lateral portion of the withdrawal opening 25.

A corner portion of the catching groove 26 connected to the lower portion, namely, the lower surface, of the terminal fastening unit 20 may be formed to have a sloped face or a curved face through chamfering, or the like. Accordingly, a phenomenon in which the lead wire L led out through the catching groove 26 is bent by the corner portion of the catching groove 26 can be minimized.

Also, in the present embodiment, the catching groove 26 may be formed by removing portions of the terminal fastening unit 20 in a direction (or a tangent direction of the coils 50) in which the respective coils 50 are wound at a lower side of the primary coil 51 and the secondary coil 52 continuously wound in the winding unit 12. Namely, in the present embodiment, the catching groove 26 is formed to have a linear shape, but the present invention is not limited thereto and the catching groove 26 may be formed by removing portions of the terminal fastening unit 20 in an arc shape according to the shape of the coil 50 wound in an annular shape.

Accordingly, when the lead wire L of the coil (e.g., the primary coil; Np2, Np3) is led out from the terminal fastening unit 20 along the catching groove 26 from the interior of the winding unit 12, it is led out by traversing (or crossing) the catching groove 26 in the length direction of the catching groove 26 (namely, it traverses the catching groove 26 in the length direction of the catching groove 26 so as to be led out), and accordingly, the lead wire L is led out at an angle of less than 45° with respect to the other order of coil (e.g., the secondary coil; Ns4) wound in the winding unit 12.

Also, the catching groove 26 according to the present embodiment includes two stopping openings 26*a* and 26*c* formed in the first withdrawal opening 25*a* through which the primary coil 51 is led out and one catching groove 26*b* formed in the second withdrawal opening 25*b* through which the secondary coil 52 is led out. The configuration of the catching groove 26 will be described in detail in describing the coil 50 later.

Meanwhile, leakage inductance generated when the transformer 100 according to the present embodiment is driven can be minimized by virtue of the withdrawal opening 25 and the catching groove 26.

In the case of the related art transformer, generally, a lead wire of a coil is led out along an internal wall surface in a space in which the coil is wound, and thus, the wound coil and the lead wire of the coil may be in contact.

Thus, the coil is wound to be bent at a point at which the coil is in contact with the lead wire, and such a bent portion of the coil, namely, an uneven winding, results in an increase in leakage inductance.

However, in the transformer 100 according to the present embodiment, the lead wire L of the coil 50 is directly led out to the outside of the winding unit 12, namely, downwardly from the terminal fastening unit 20, in a vertical direction through the withdrawal opening 25 and the catching groove 26 from the position which the coil 50 is wound, rather than being disposed within the winding unit 12.

Thus, the coil 50 wound within the winding unit can be uniformly wound overall, and thus, leakage inductance otherwise generated as the coil 50 is bent, or the like, can be minimized.

A plurality of catching grooves 28 may be formed to be protruded from one surface of the terminal fastening unit 20, and in the present embodiment, a case in which the plurality of catching grooves 28 are protruded downwardly from an outer surface (i.e., lower surface) of the terminal fastening unit 20 is taken as an example.

As shown in FIG. 2B, the catching grooves 28 serve to guide the lead wire L of the coil 50 wound in the winding unit 12 such that the lead wire L is easily disposed on the external connection terminal 30 at a lower side of the terminal fastening unit 20. Thus, the catching protrusion 28 may be protruded to be greater than the diameter of the lead wire L of the coil 50 in order to firmly support the coil 50 caught thereon.

Owing to the catching grooves 28, a disposition direction of the lead wires L led out from the catching groove 26 may be changed in various directions as necessary. This will be described in detail as follows.

As shown in FIG. 4B, in the transformer 100 according to the present embodiment, preferably, the lead wires L of the coil 50 are led out (or led in) in a tangent direction (or in the winding direction) with respect to the outer circumferential surface of the coils 50 wound in the winding space (12*c* in FIG. 4A). This is to prevent the lead wire L of the coil 50 from being led out at an angle of 45° or more from the winding space 12*c* in a state of being in contact with the other order of coil 50 wound in the winding space 12*c*.

As mentioned above, when the primary coil 51 and the secondary coil 52 are in contact under tension, it is required for an intersecting angle at a portion in which the primary coil 51 and the secondary coil 52 are in contact to be less than 45° in order to secure (or ensure) insulating reliability.

Thus, as described above, when the lead wires L of the coil 50 are configured to be led out (or led in) in the tangent direction (or in the winding direction) with respect to the outer circumferential surface of the coils wound in the winding space 12*c*, the lead wires L of the coil 50 and the coils 50 wound in the winding space 12*c* are naturally at an angle less than 45°.

To this end, in the transformer 100 according to the present embodiment, the catching groove 26 are formed extendedly in the direction in which the lead wires L are led so that the lead wires L of the coil 50 can be easily led out in the tangent direction (or in the winding direction), and here, the lead wires L are led out by traversing the catching groove 26 in the length direction of the catching groove 26.

Meanwhile, as illustrated in FIGS. 3B and 4B, when the lead wires L of the coil 50 are led in the tangent direction (or in the winding direction 0, some lead wires (L2) may be led out in a direction opposite to the direction in which the external connection terminal 30, to which the lead wires (L2) are to be connected, is disposed.

In this case, the path should be changed after the lead wires L2 are completely led out downwardly of the terminal fastening unit 20. To this end, in the transformer 100 according to the present embodiment, the disposition path of the lead wires L2 is changed by using the catching grooves 28.

Thus, like the secondary terminal fastening unit 20*b* according to the present embodiment, when the external connection terminals 30, to which the respective lead wires L are to be connected, are disposed in the direction in which the lead wires L are led out from the catching groove 26*b*, such catching grooves 28 may be omitted.

However, like the primary terminal fastening unit 20*a*, when the corresponding external connection terminals 30 are disposed in a direction opposite to the direction in which the lead wires L2 are led out, the lead wires L2 support the catching grooves 28 and a disposition path thereof may be changed.

The lead wires L2, having changed in a disposition direction into the direction opposite to the withdrawal direction while supporting the catching grooves 28, may be changed again in the disposition direction into a direction in which the external connection terminals 30 are fastened, while supporting other catching grooves 28.

Thus, in order to allow the lead wires L led out from the catching groove 26 to be easily changed in the disposition direction, at least one of the catching grooves 28 according to the present embodiment may be disposed to be adjacent to the catching groove 26.

Meanwhile, at least one of the catching grooves 28 may be configured to have a step formed on at least one lateral face. As illustrated in FIG. 3A, a catching protrusion having a step (hereinafter, referred to as a 'double catching protrusion 29') may include a base protrusion 29*a* and a support protrusion 29*b*.

The base protrusion 29*a* is formed to be protruded to have an end having a size with a certain area. Thus, the base protrusion 29*a* may support the lead wires through the end, as well as supporting the lead wires through a side wall thereof, like the other catching grooves 28 do. Namely, the base protrusion 29*a* can support at least two lead wires simultaneously.

The support protrusion 29*b* is formed to be further protruded from any one portion of the end of the base protrusion 29*a*. The support protrusion 29*b* may be formed to be similar in shape, size, and the like, to the other catching grooves 29 and only different in that it is protruded from the end of the base protrusion 29*a*.

A movement of the lead wire L, which is supported by the end of the base protrusion 29*a* by the support protrusion 29*b*, in a particular direction may be fixed. Also, the lead wire L supported by the side wall of the base protrusion 29*a* is prevented from being easily released from the double catching protrusion 29.

The double catching protrusion 29 configured as described above according to the present embodiment is provided to prevent the lead wires L from being in contact in an intersecting manner when the lead wires L are disposed on a lower surface of the terminal fastening unit 20.

As illustrated in FIG. 3B, as the disposition path of the lead wires L is complicated, the lead wires L may be disposed to be in contact in an intersecting manner. Thus, in order to avoid this, the transformer 100 according to the present embodiment includes and uses the double catching protrusion 29.

Since the double catching protrusion 29 is provided, a particular lead wire L1 led out from the catching groove 26 may be changed in a disposition direction thereof, while being supported by the side wall formed by the base protrusion 29*a* and the support protrusion 29*b* in conjunction.

Also, the other lead wire L2 may be disposed to intersect the particular lead wire L1, while being supported by the end of the base protrusion 29*a*. Accordingly, the particular lead wire L1 and the other lead wire L2 are spaced apart by the base protrusion 29*a* and intersect each other, thus minimizing interference therebetween.

A plurality of guide protrusions 27 are formed to be protruded in parallel from one surface of the terminal fastening unit 20. In the present invention, a case in which the guide protrusions 27 are protruded downwardly from the lower surface of the terminal fastening unit 20 is taken as an example.

The guide protrusions 27 are protruded in parallel to correspond to the fastening positions of the external connection terminals 30. Here, the respective guide protrusions 27 may have an identical shape or may have various shapes as necessary like the guide protrusions 27 formed on the secondary terminal fastening unit 20*b*.

As shown in FIG. 2B, the guide protrusions 27 serve to guide the lead wires L of the coil 50 led out from the catching groove 26 or the catching grooves 28 such that the lead wires L are easily disposed on the external connection terminals 30. Thus, the guide protrusions 27 may be protruded to be greater than the diameter of the lead wires L of the coil 50 in order to firmly support and guide the coil 50 disposed therebetween.

The lead wires L led out from the terminal fastening unit 20 by way of the catching groove 26 by the guide protrusions 27 are changed in the disposition direction, while supporting the catching grooves 28, and then, electrically connected to the external connection terminals 30 through the space between the guide protrusions 27.

The configuration of the terminal fastening unit 20 according to the present embodiment, configured as described above, is devised in consideration of a case in which the coil 50 is automatically wound around the bobbin 10.

Namely, owing to the configuration of the bobbin 10 according to the present embodiment, a process of winding the coil 50 around the bobbin 10, a process of passing the lead wires L of the coil 50 to a lower side of the bobbin 10 through the withdrawal opening 25 and the catching groove 26, a process of drawing out the lead wires L in the direction in which the external connection terminals 30 are formed by changing the path of the lead wires L through the guide protrusions 27, and then, fastening the lead wires L to the external connection terminals 30, and the like, may be automatically performed by automatic winding equipment (not shown).

The plurality of external connection terminals 30 may be fastened to the terminal fastening unit 20. The external connection terminals 30 are formed to be protruded from the terminal fastening unit 20 and may have various shapes according to a shape or structure of the transformer 100 or according to a structure of a substrate on which the transformer 100 is mounted.

Namely, the external connection terminals 30 according to the present embodiment are fastened to the terminal fastening unit 20 such that they are protruded from the terminal fastening unit 20 in an outer diameter direction of the body portion 13. However, the present invention is not limited thereto and the external connection terminals 30 may be formed in various positions as necessary. For example, the external connection terminals 30 may be fastened to be protruded downwardly from the lower surface of the terminal fastening unit 20.

Also, the external connection terminals 30 according to the present embodiment may include an input terminal 30*a* and an output terminal 30*b*.

The input terminal 30*a* is fastened to the primary terminal fastening unit 20*a* and connected to the lead wire L of the primary coil 51 to supply power thereto. Also, the output terminal 30*b* is fastened to the secondary terminal fastening unit 20*b* and connected to the lead wire L of the secondary coil 52 to supply output power set according to a winding ratio between the secondary coil 52 and the primary coil 51 to the outside.

The external connection terminals 30 according to the present embodiment include a plurality of (e.g., four) input terminals 30*a* and a plurality of (e.g., seven) output terminals 30*b*. This configuration is devised as the transformer 100 is configured such that a plurality of coils 50 may be wound in a stacked manner in the single winding unit 12. Thus, the external connection terminals 30 in the transformer 100 according to an embodiment of the present invention are not limited to the foregoing amount.

The input terminals 30*a* and the output terminals 30*b* may have the same shape or may have different shapes as necessary. Also, the external connection terminals 30 according to the present embodiment may be variably modified so long as the lead wires L can be easily connected thereto.

In the bobbin 10 according to the present embodiment configured as described above, the primary coil 51 and the secondary coil 52 are wound in a stacked manner in the internal winding space 12*c*, but there is no insulating member between the primary coil 51 and the secondary coil 52. Thus, in order to secure insulating reliability at the point in which the primary coil 51 and the secondary coil 52 are in contact, an intersecting angle at the point in which the primary coil 51 and the secondary coil 52 are in contact should necessarily be less than 45°.

Namely, when the primary coil 51 and the secondary coil 52 cross to the maximum level in the single winding space, the intersecting angle between the primary coil 51 and the secondary coil 52 should be maintained at less than 45°.

FIGS. 5A through 5E are side views explaining the intersecting angle of the transformer according to an embodiment of the present invention. The present invention will be described in more detail with reference to FIGS. 5A through 5E.

Figure 5A:
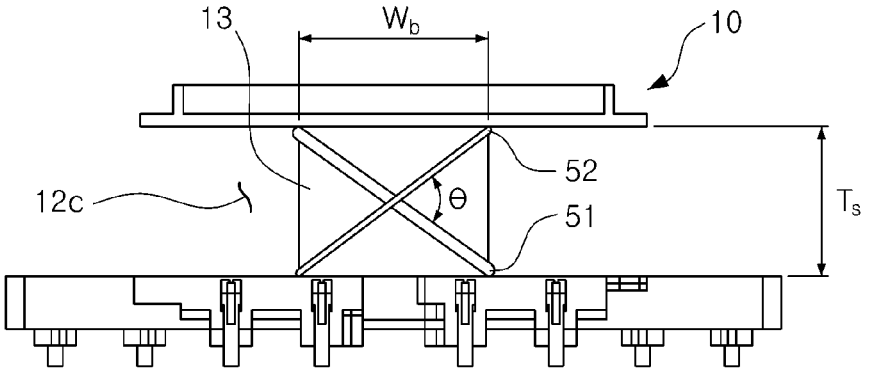
FIGS. 5A through 5E are side views explaining an intersection angle of the transformer according to an embodiment of the present invention.

Like the bobbin 10 illustrated in FIG. 5A, when the body portion 13 is formed to have a small diameter $W_b$ and a length $T_s$ (i.e., the width of the winding space) similar to the diameter W, a maximum intersecting angle θ between the primary coil 51 and the secondary coil 52 is highly likely to be 45° or more.

Thus, as mentioned above, in the transformer 100 according to the present embodiment, the diameter $W_b$ and the length $T_s$ of the body portion 13 are limited such that the intersecting angle θ between the primary coil 51 and the secondary coil 52 is maintained at less than 45°.

In detail, in the winding space 12*c* according to the present embodiment, the width $W_b$ (i.e., the diameter of the body portion 13) is longer than the length $T_s$ (i.e., the width of the winding space 12*c*). Here, the ratio between the width $W_b$ and the length $T_s$ of the winding space 12*c* may be approximately 100:40 and may be definitely defined by conditional expression 1 shown below.

$$T_s \leq 0.4 W_b \qquad \text{(Conditional expression 1)}$$

Here, $T_s$ is the width of the winding space, and $W_b$ is the diameter of the body portion.

According to conditional expression 1, the winding diameter $T_s$, i.e., the length, of the winding space 12*c* is less than 0.45 times the diameter $W_b$ of the body portion 13.

Figure 5B:
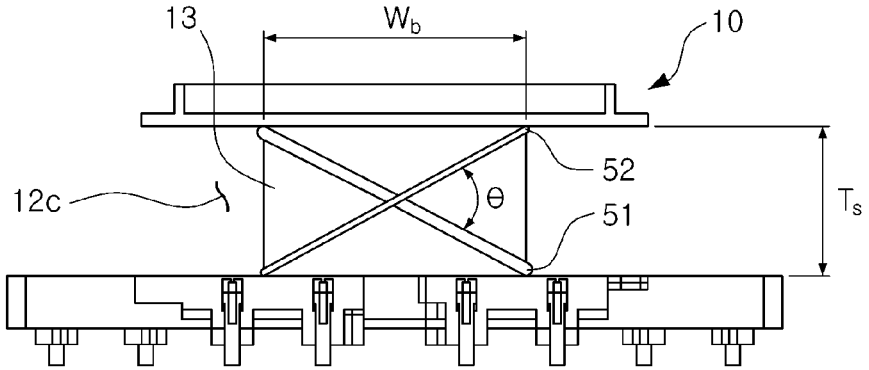

When the winding space 12*c* is limited in this manner, as shown in FIG. 5B, a maximum intersecting angle θ between the primary coil 51 and the secondary coil 52 is formed to be approximately less than 45°.

Meanwhile, as shown in FIG. 4B, in the transformer 100 according to the present embodiment, at least one coil (e.g., the primary coil Np2) is wound to form one layer in the winding space 12*c* and another coil (e.g., the secondary coil Ns1-Ns4) is wound thereon in a stacked manner.

Figure 5C:
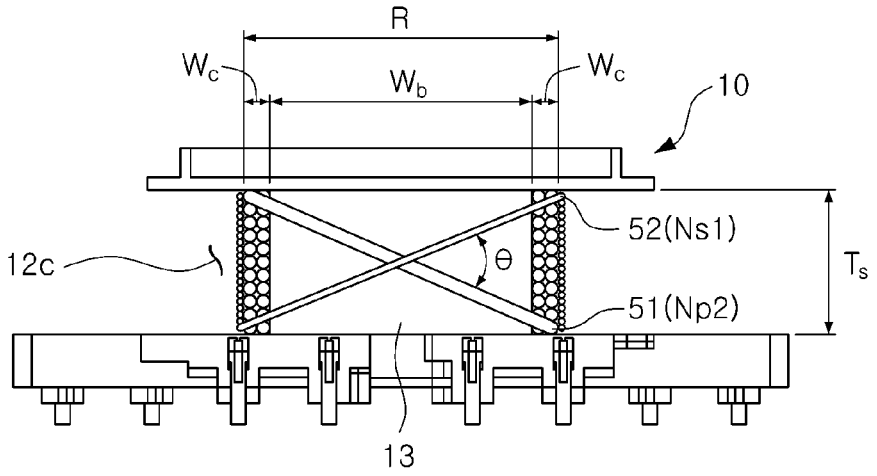

Thus, as shown in FIG. 5C, the primary coil 51 and the second coil 52 actually intersect on an outer circumferential surface of the coil (e.g., Np2 in FIG. 4B, which is referred to as an 'inner coil', hereinafter) which is first wound on the body portion 13, rather than on an outer circumferential surface of the body portion 13.

Thus, conditional expression 1 may be modified as per conditional expression 2 shown below.

$$T_s \leq 0.4R \quad \text{(Conditional expression 2)}$$

$$R=(W_b+2W_C) \quad \text{(Conditional expression 3)}$$

Here, $T_s$ is the width of the winding space 12*c*, and R is a diameter based on the outer circumferential surface of the inner coil Np2. Also, $W_b$ is the diameter of the body portion 13, and $W_c$ is the winding thickness of the inner coil Np2.

Also, the diameter R of the inner coil Np2 in conditional expression 3 should include the winding thicknesses $W_c$ of the inner coil Np2 at both edges of the distance of the diameter $W_b$ of the body portion 13, so the double of the winding thickness $W_c$ of the inner coil Np2 was added to the diameter $W_b$ of the body portion 13 to obtain the diameter R.

According to conditional expression 2, the winding diameter $T_s$, i.e., the length of the winding space 12*c*, is formed to be less than 0.4 times the diameter R formed by the outer circumferential surface of the inner coil Np2.

Accordingly, the diameter $W_b$ of the body portion may be formed to be substantially smaller than the diameter R formed by the inner coil Np2.

Here, the amount of the inner coil Np2 wound around the body portion 13 may differ according to the characteristics of respective transformers. Namely, when the winding thickness $W_c$ of the inner coil Np2 is formed to be relatively large, the body portion 13 of the bobbin 10 may be formed to have a relatively small diameter $W_b$, and conversely, when the winding thickness $W_c$ of the inner coil Np2 is formed to be relatively small, the body portion 13 of the bobbin 10 may be formed to have a relatively large diameter $W_b$.

Meanwhile, in the transformer 100 according to the present embodiment, the case in which the winding thickness $W_c$ of the inner coil Np2 is formed to be about one-tenth the diameter of the body portion 13 is taken as an example. In this case, the diameter $W_b$ of the body portion 10 may be formed to be about 90% of the diameter R formed by the inner coil Np2 as expressed by conditional expression 4 below.

$$W_b \approx 0.9R \quad \text{(Conditional expression 4)}$$

Thus, conditional expression 5 and conditional expression 6 can be obtained by applying conditional expression 4 to conditional expression 2.

$$T_s \leq 0.4(W_b/0.9) \quad \text{(Conditional expression 5)}$$

$$T_s \leq 0.45W_b \quad \text{(Conditional expression 6)}$$

Here, 0.45 is a value obtained by rounding off a value 0.4/0.9.

When the diameter $W_b$ of the body portion 10 is formed to be about 90% of the diameter R formed by the inner coil Np2, it is noted that the maximum intersecting angle θ between the primary coil 51 and the secondary coil 52 can be maintained at less than 45° when the width $T_s$ of the winding space 12*c* is less than about 0.45 times the diameter $W_b$ of the body portion 13.

Meanwhile, in the transformer 100 according to an embodiment of the present invention, the size of the bobbin 10 is not limited by the foregoing conditional expressions. Namely, the foregoing conditional expressions may be variably modified by the thickness of the inner coil Np2, the winding thickness $W_c$, and the like.

Meanwhile, FIGS. 5A through 5C illustrate the bobbin without a partition wall according to an embodiment of the present invention. However, when the amount of the coil wound around the bobbin is large or when the coil 50 is required to be wound evenly to the utmost, the bobbin 10 having the winding space 12*c* partitioned by the partition wall 14 may be used.

Figure 5D:
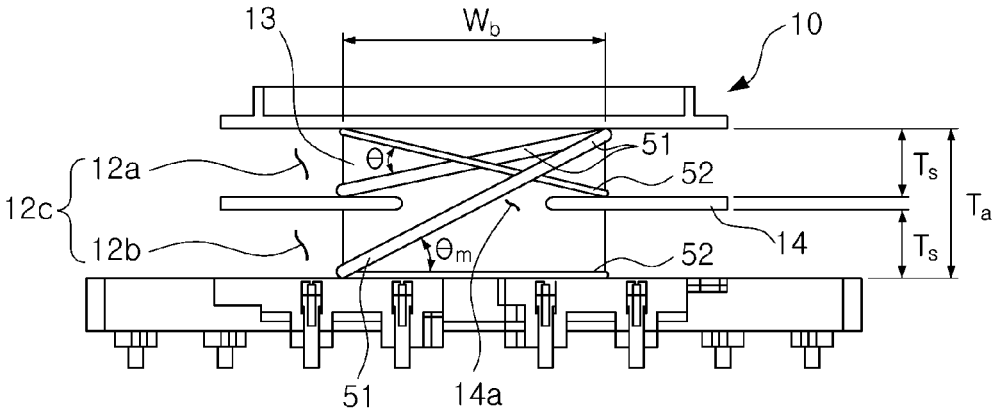

Namely, as shown in FIGS. 4B and 5D, the entire winding space 12*c* may be partitioned into a plurality of partitioned winding spaces 12*a* and 12*b* and the coil 50 may be evenly distributed and wound in the respective partitioned winding spaces 12*a* and 12*b*.

In this case, the limitation of conditional expression 2 or conditional expression 6 may be applied to the respective partitioned winding spaces 12*a* and 12*b*. Namely, the respective partitioned winding spaces 12*a* and 12*b* may be formed such that the ratio between the diameter R formed by the inner winding or the diameter $W_b$ of the body portion and the width $T_s$ of the respective partitioned winding spaces 12*a* and 12*b* is limited by the foregoing conditional expression 1 or conditional expression 5.

Accordingly, the maximum intersecting angle between the primary coil 51 and the secondary coil 52 can be maintained at less than 45° within the respective partitioned winding spaces 12*a* and 12*b*.

Also, as shown in FIG. 5D, when at least any one (e.g., the primary coil) of the coils is wound in a diagonal direction of the body portion 13 across the skip groove 14*a*, the primary coil 51 and the secondary coil 52 may intersect at an angle of $\theta_m$. Also, in this case, since the primary coil 51 and the secondary coil 52 intersect at the angle of $\theta_m$, the intersecting angle $\theta_m$ should be less than 45° as mentioned above.

In order for the intersecting angle $\theta_m$ to be maintained at less than 45°, the diameter $W_b$ of the body portion 13 should be greater than the thickness $T_s$ of the entire winding space. Also, since the respective partitioned winding spaces 12*a* and 12*b* should satisfy the foregoing conditional expression 6, conditional expression 7 shown below can be obtained.

$$T_a \leq 0.9W_b \quad \text{(Conditional expression 7)}$$

Here, the thickness $T_s$ of the entire winding space is calculated to be double of the thickness $T_s$ of the individual winding space and the thickness by the partition wall 14 was disregarded.

Also, instead of the diameter $W_b$ of the body portion, the diameter R formed by the inner winding Np2 may be substituted. However, when the diameter R formed by the inner winding Np2 is substituted, since it is included in conditional expression 7, conditional expression 7 was obtained based on the diameter $W_b$ of the body portion 13.

Figure 5E:
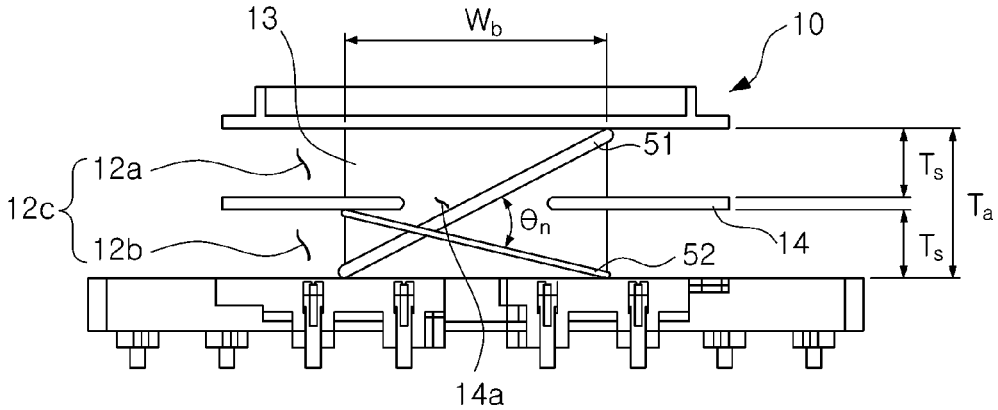

Also, as shown in FIG. 5E, a case in which the coils 51 and 52 are wound to intersect at an intersecting angle $\theta_n$ around the bobbin 10 formed to have a plurality of winding areas 12*a* and 12*b* may be considered.

In this case, the intersecting angle $\theta_n$ between the primary coil 51 and the secondary coil 52 is about 1.5 times the intersecting angle $\theta_m$ of the case of FIG. 5D as described above.

Thus, in order for the intersecting angle to be maintained at less than 45°, the intersecting angle $\theta_m$ in FIG. 5D should be less than 30°. Thus, it can be seen that the thickness $T_s$ of the entire winding space 12*c* should be 0.57 times the diameter $W_b$ of the body portion 13 through formula of triangles.

Thus, conditional equation 8 shown below can be obtained.

$$T_a \leq 0.57W_b$$

Here, the thickness $T_s$ of the entire winding space 12*c* does not include the thickness of the partition wall 14. Thus, when the thickness of the partition wall 14 is included, the thickness $T_s$ of the entire winding space 12*c* may be slightly smaller than conditional expression 8. For example, the thickness $T_s$ of the entire winding space 12*c* may be about 0.55 times the diameter $W_b$ of the body portion 13.

Meanwhile, when conditional expression 7 and conditional expression 8 are considered together, it can be seen that conditional expression 7 is included in the range of conditional expression 8. Thus, in the transformer 100 according to the present embodiment, when the plurality of partitioned winding spaces 12*a* and 12*b* are provided in the bobbin 10, the thickness Ts of the entire winding space 12*c* is about 0.57 times the diameter $W_b$ of the body portion 13.

As described above, in the transformer according to the present embodiment, the width $W_c$ of the winding space 12*c* and the diameter $W_b$ of the body portion 13 are limited to maintain the maximum intersecting angle between the primary coil and the secondary coil at less than 45°.

Namely, when only a single winding space 12*c* is provided, the width $T_s$ of the winding space 12*c* may be formed to be less than about 0.45 times the diameter $W_b$ of the body portion 13, and when a plurality of partitioned winding spaces 12*a* and 12*b* are provided, the width $T_s$ of the entire winding space may be less than about 0.57 times the diameter $W_b$ of the body portion 13. In other words, the length of the body portion 13 may be less than about 0.45 times or 0.57 times the diameter $W_b$ of the body portion 13 according to the amount of the partitioned winding spaces 12*c*.

Accordingly, in the transformer 10 according to the present embodiment, although an insulating member is omitted between the primary coil 51 and the secondary coil 52 and the coil 50 is wound around the bobbin 10 through automatic winding equipment, or the like, insulating reliability between the primary coil 51 and the secondary coil 52 can be easily secured.

Meanwhile, in the foregoing conditional expressions, in most cases, the size of the partitioned winding spaces 12*a*, 12*b*, and 12*c* is limited. However, the present invention is not limited thereto and, even when conditional expressions are applied based on a winding form of the coil 50 wound in the partitioned winding spaces 12*a*, 12*b*, and 12*c*, the same effect can be obtained.

In detail, the width $T_s$ of the winding space as described above may be applied as a winding diameter $T_s$ of the coils wound in the winding space, rather than as the winding space 12*c*. Then, regardless of the size of the winding space 12*c*, the coil 50 may be wound such that the winding diameter $T_s$ of the coil 50 is less than 0.4 times or 0.45 times the foregoing diameter (R or $W_b$) or may be wound such that the entire winding diameter $T_s$ of the divided coil 50 is 0.57 times or less of the diameter $W_b$ of the body portion to obtain the same structure and effect.

The bobbin 10 according to the present embodiment may be easily fabricated through injection molding, but the present invention is not limited thereto. Also, preferably, the bobbin 10 according to the present invention is made of an insulating resin and may be made of a material having high heat resistance and high withstand voltage characteristics. For example, as a material used for forming the bobbin 10, polyphenylene Sulfide (PPS), liquid crystal polyester (LCP), polybutyleneterephthalate (PBT), polyethyleneterephthalate (PET), a phenol-based resin, or the like, may be used.

With a portion of the core 40 inserted into the through hole 11 formed within the bobbin 10, the core 40 forms a magnetic circuit electromagnetically coupled to the coil 50.

In the present embodiment, a pair of cores 40 are configured, and portions thereof may be inserted into the through hole 11 of the bobbin 10 and coupled to be in contact with each other in a facing manner. As the core 40, an 'EE' core, an 'EI' core, a 'UU' core, a 'UI' core, or the like, may be used according to shapes thereof.

The core 40 may be made of Mn—Zn-based ferrite having high magnetic permeability, low loss, high saturation magnetic flux density, stability, and low production costs in comparison to other materials. However, the shape or material of the core 40 is not limited thereto in an embodiment of the present invention.

Meanwhile, although not shown, insulating tape may be interposed between the bobbin 10 and the core 40 in order to secure insulation between the coil 50 wound around the bobbin 10 and the core 40.

The insulating tape may be interposed to correspond to every internal surface of the core 40 which faces the bobbin 10, and partially interposed only on a portion in which the coil 50 and the core 40 face each other.

The coil 50 may be wound in the winding unit 12 of the bobbin 10 and may include a primary coil and a secondary coil.

Figure 6A:
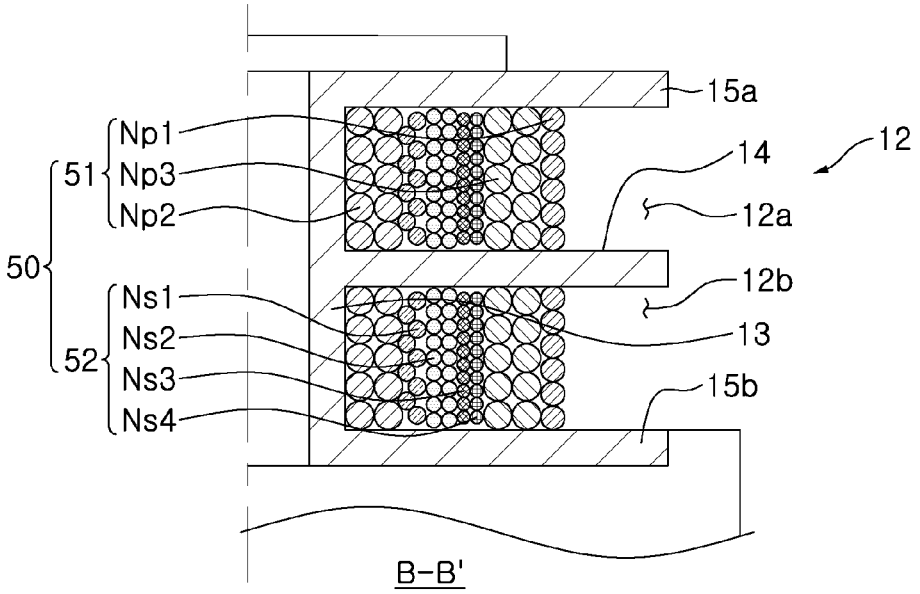
FIG. 6A is a cross-sectional view taken along line B-B' in FIG. 3B.
Figure 6B:
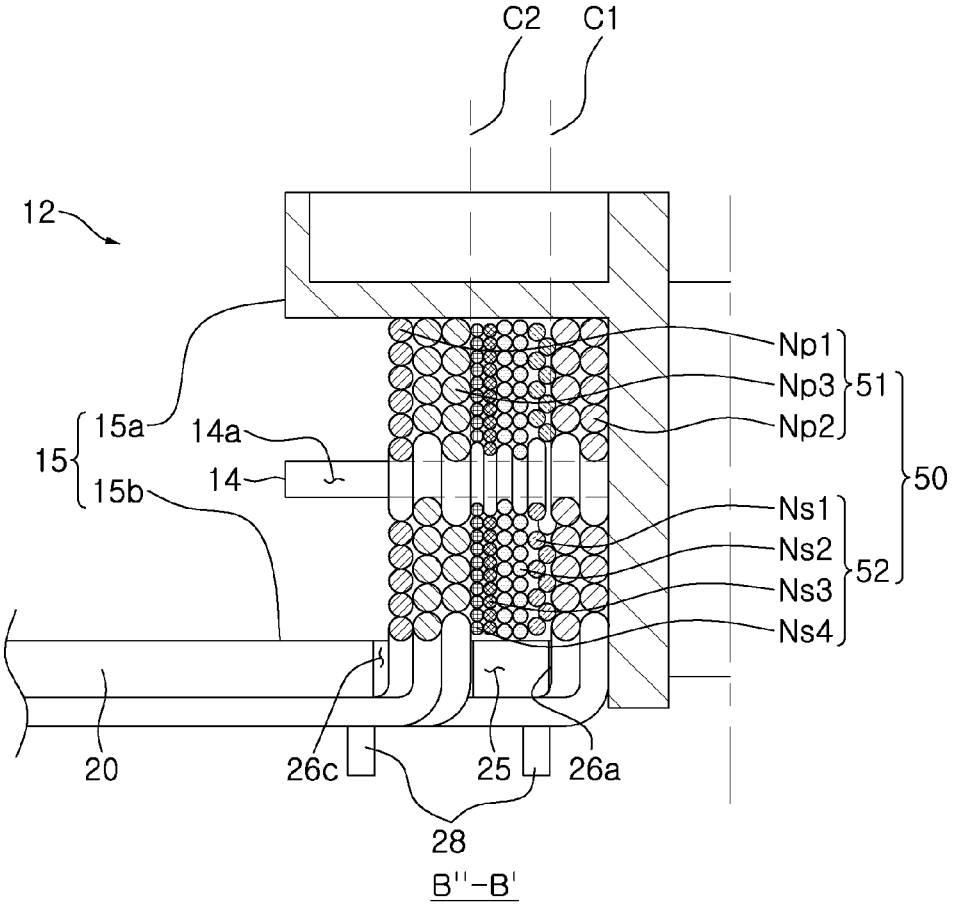
FIG. 6B is a cross-sectional view taken along line B"-B' in FIG. 3B.
Figure 6C:
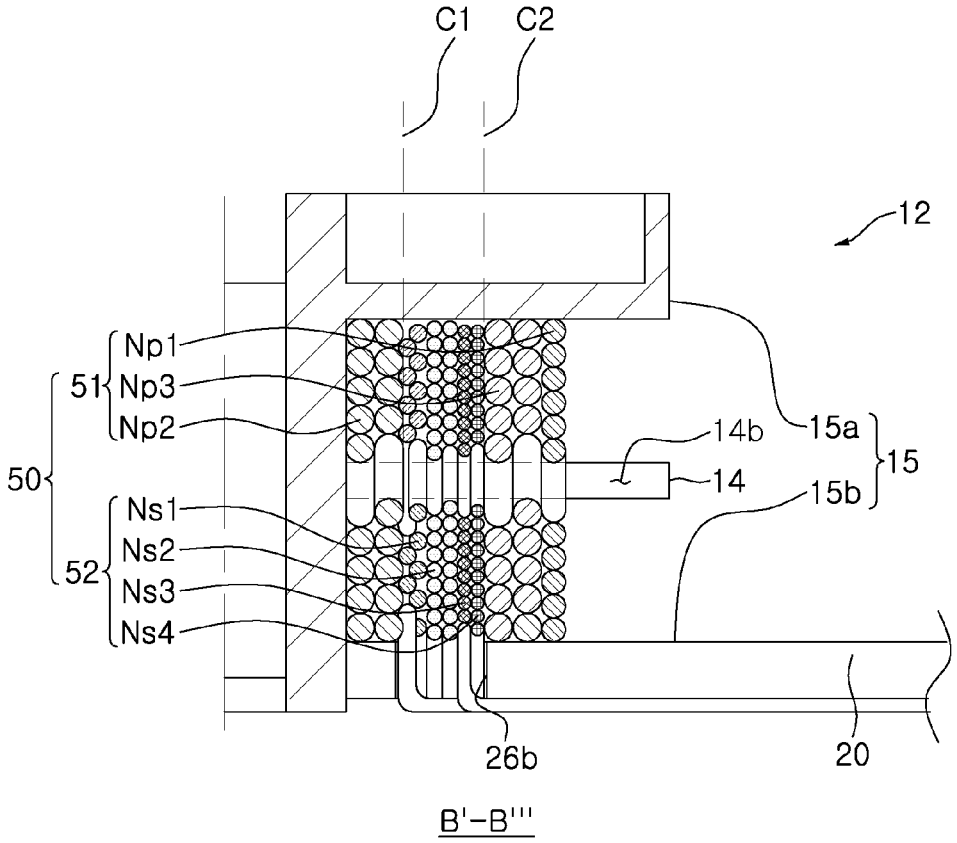
FIG. 6C is a cross-sectional view taken along line B'-B'" in FIG. 3B.

FIG. 6A is a cross-sectional view taken along line B-B' in FIG. 3B. FIG. 6B is a cross-sectional view taken along line B"-B' in FIG. 3B. FIG. 6C is a cross-sectional view taken along line B'-B'" in FIG. 3B.

With reference to FIGS. 6A through 6C, the primary coil 51 may include a plurality of coils Np1, Np2, and Np3 which are electrically insulated from each other. In the present embodiment, a case in which three independent coils Np1, Np2, and Np3 are wound within the single winding unit 12 is taken as an example. Thus, a total of six strands of lead wires L are led from the primary coil 51 and connected to the external connection terminals 30. Meanwhile, in FIG. 1, only several strands of lead wires L are representatively illustrated in FIG. 1 for the sake of explanation.

With reference to FIG. 6A, in the present embodiment, as the primary coil 51, the coils Np1, Np2, and Np3 having a similar thickness are used. However, the present invention is not limited thereto and the respective coils Np1, Np2, and Np3 constituting the primary coil 51 may be configured to have different thicknesses as necessary. Also, the amounts of the windings of the respective coils Np1, Np2, and Np3 may be equal or different as necessary.

In addition, in the transformer 100 according to the present embodiment, when a voltage is applied to any one (e.g., Np2, Np3) of the plurality of primary coils 51, a voltage can be extracted from the other primary coil 51 (e.g., Np1) according to an electromagnetic induction. Thus, this may be used in a display device as described hereinafter.

In this manner, in the transformer 100 according to the present embodiment, since the primary coil 51 is configured by the plurality of coils Np1, Np2, and Np3, various voltages can be applied, and accordingly, various voltages can be extracted through the secondary coil 52.

Meanwhile, in the present embodiment, the primary coil 51 is not limited to the three independent coils Np1, Np2, and Np3, and varying amounts of coils may be used as necessary.

Like the primary coil 51, the secondary coil 52 is wound in the winding unit 12. In particular, the secondary coil 52 according to the present embodiment is stacked in a sandwich form and wound between the primary coils 51.

Like the primary coil 51, the secondary coil 52 may be formed as a plurality of coils electrically insulated from each other are wound.

In detail, in the present embodiment, a case in which the secondary coil 52 includes four independent coils Ns1, Ns2, Ns3, and Ns4 which are electrically insulated from each other is taken as an example. Thus, a total of eight strands of lead wires L may be led out from the secondary coil 52 and connected to the external connection terminals 30.

Also, as the respective coils Ns1, Ns2, Ns3, and Ns4 of the secondary coil 52, coils having the same thickness or coils having different thicknesses may be selectively used, and the amounts of windings of the respective coils Ns1, Ns2, Ns3, and Ns4 may be equal or different as necessary.

Individual coils Np1-Np4 according to the present embodiment may be substantially uniformly distributed and wound within the spaces 12*a* and 12*b* partitioned by the partition wall 14.

In detail, the same amounts of respective coils Np1-Ns4 are wound in the upper winding space 12*a* and the lower winding space 12*b*, and as shown in FIG. 6A, the respective coils Np1-Ns4 are disposed to form the vertically identical layers. Accordingly, the respective coils Np1-Ns4 wound in the upper winding space 12*a* and the lower winding space 12*b* have the same shape.

Here, when the amount of windings of the respective coils Np1-Ns4 is set to be an odd number, the corresponding coils Np1-Ns4 may be wound by making a difference in the amount of windings at a ratio of 10% of the entire winding amounts.

Such a configuration aims at minimizing a generation of leakage inductance in the transformer 100 according to a winding state of the coil 50.

In general, when the coil is wound in the winding unit of the bobbin, if the coil is not uniformly wound on the whole but would to be inclined to one side or non-uniformly disposed and wound, leakage inductance is increased in the transformer. This problem may be aggravated when the space of the winding unit is large.

Thus, in order to minimize leakage inductance generated due to the foregoing reasons, the winding unit 12 is divided into several partitioned spaces 12*a* and 12*b* by using the partition wall 14 in the transformer 100 according to the present embodiment. The coil 50 is evenly wound to the maximum in the respective partitioned spaces 12*a* and 12*b*.

In this connection, for example, when the total amount of windings of the coil Ns1 is 18 times, the coil Ns1 may be wound nine times in the upper winding space 12*a* and nine times in the lower winding space 12*b* so as to be uniformly distributedly disposed, respectively.

Also, when the amount of windings is set to be an odd number (e.g., 50 times), a difference may be made at a ratio of some 10% such that the coil is disposed 23 times in the upper winding space 12*a* and 27 times in the lower winding space 12*b*.

Meanwhile, with reference to the drawings, in the present embodiment, the coil Ns1 is not densely or compactly wound, and wound 8 times in the first layer and 10 times in the second layer. Thus, two lead wires (not shown) of the coil Ns1 are all directed to a lower side of the winding unit 12, so they can be easily led out from the terminal fastening unit 20 and connected to the external connection terminals 30.

In the present embodiment, the foregoing winding structure is illustrated only for the coil Ns1 for the sake of explanation, but the present invention is not limited thereto and the winding structure may also be easily applied to the other coils.

In this manner, in the transformer 100 according to the present embodiment, although the winding amount or the thickness of the coils is small in comparison to the partitioned winding spaces 12*a* and 12*b* (e.g., the coil Ns1) so the coils are not densely or tightly wound in the winding unit 12, since the winding unit 12 is divided into the plurality of partitioned spaces 12*a* and 12*b*, the coil (e.g., Ns1) can be wound to be distributedly disposed in the same position within the respective partitioned spaces 12*a* and 12*b*, without being inclined to one side.

In this manner, in the transformer 100 according to the present embodiment, the independent coils Np1-Ns4 are uniformly distributed and disposed in the upper winding space 12*a* and the lower winding space 12*b* according to the structure and winding scheme of the bobbin 10 as described above. Thus, the coils Np1-Ns4 are prevented from being inclined to one side and wound or non-uniformly separated and wound on the whole, and accordingly, leakage inductance generated as the coils Np1-Ns4 are wound irregularly can be minimized.

Meanwhile, as shown In FIG. 6B, the catching groove 26 according to the present embodiment is formed to correspond to contact surfaces C1 and C2 of the primary coil 51 and the secondary coil 52 continuously wound in a stacked manner in the winding unit 12, namely, a position from which the lead wires L are led.

Here, outer and inner circumferential surfaces of the primary coil 51 and the secondary coil 52 which are continuously wound refer to annular outer and inner circumferential surfaces formed as the coils 50 are wound in the winding unit 12.

Also, the contact surfaces C1 and C2 of the primary coil 51 and the second coil 52 refer to interface on which the outer or inner circumferential surface of the primary coil 51 is in contact with the inner or outer circumferential surface of the secondary coil 52.

In the present embodiment, the Np2 of the primary coil 51 is wound separately from Np3 and Np1 of the primary coils, so the primary coils 51 has a total of two outer circumferential surfaces and a total of two inner circumferential surfaces (i.e., the outer and inner circumferential surfaces by Np2 and the outer and inner circumferential surfaces by the Np1 and Np3).

Meanwhile, four individual coils Ns1-Ns4 of the secondary coils 52 are continuously wound in a stacked manner, so the secondary coils 52 have a total of one outer circumferential surface (i.e., an outer circumferential surface by Ns4) and a total of one inner circumferential surface (i.e., an inner circumferential surface by Ns1). Here, the outer circumferential surface C2 and inner circumferential surface C1 of the secondary coils 52 are formed as the contact surfaces C1 and C2.

Also, as illustrated, the catching groove 26 according to the present embodiment may include the first catching groove 26*a*, the second catching groove 26*b*, and the third catching groove 26*c* corresponding to the respective coils 50. Here, the first catching groove 26*a* and the third catching groove 26*c* are formed to extend from the first withdrawal opening 25*a*, and the second catching groove 26*b* is formed to extend from the second withdrawal opening 25*b*.

Also, the first catching groove 26*a* is formed at a position (i.e., a lower portion) corresponding to Np2, the second catching groove 26*b* is formed at a position corresponding to the entirety of the secondary coil 52, and the third catching groove 26*c* is formed at a position corresponding to Np3 and Np1.

Figure 7:
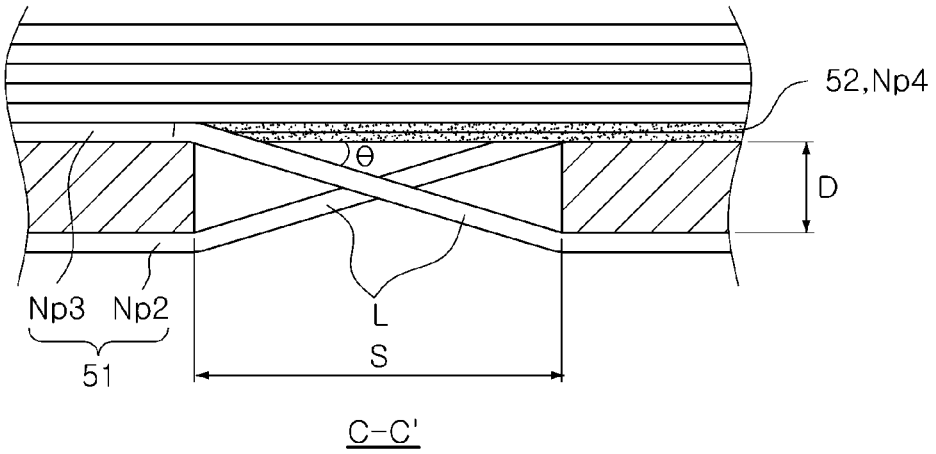
FIG. 7 is a cross-sectional view taken along line C-C' in FIG. 3B.

FIG. 7 is a cross-sectional view taken along line C-C' in FIG. 3B. With reference to FIGS. 3B and 7, in the catching groove 26 according to the present embodiment, a length S of the opening is greater than a thickness D of the terminal fastening unit. Thus, an angle θ formed by the length S of the catching groove 26 and the thickness D of the terminal fastening unit may be less than 45°.

Accordingly, the lead wires L of the coils (e.g., the primary coils Np2 and Np3) led out of the terminal fastening unit 20 along the catching groove 26 within the winding unit 12 are led out by traversing (or crossing) the catching groove 26 in the length direction of the catching groove 26, and thus, the lead wire L is led out at an angle less than 45° with respect to the other order of coil (e.g., the secondary coil Ns4) wound in the winding unit 12.

The configuration of the catching groove 26 according to the present embodiment aims at securing insulating reliability between the primary coil 51 and the second coil 52 with respect to the lead wires L led out from the winding unit 12.

As described above, when the primary coil 51 and the secondary coil 52 are in contact under tension, an angle (i.e., an acute angle) at which the primary coil 51 and the secondary coil 52 intersect while being in contact should be set to be less than 45° in order to ensure insulating reliability. Namely, when the angle formed between the primary coil 51 and the secondary coil 52 is 45° or more, it is difficult to secure insulating reliability.

To this end, in the transformer 100 according to the present embodiment, the lead wires L are led out from the outer surface of the terminal fastening unit 20 and then fastened to the external connection terminal 30.

Here, if the lead wires (e.g., the lead wires of Np3 as a primary coil) are immediately led out directly to the lower side from the contact surface (C2 in FIG. 6B), the lead wires are led at an angle of 90° in a state being in contact with the different order of coil (e.g., Ns4 as a secondary coil) which is continuously wound. In this case, insulating reliability cannot be secured.

Thus, in order to solve the problem, in the transformer according to the present embodiment, as shown in FIG. 7, the lead wire L of the coil (e.g., Np2) is led out in a manner of traversing the catching groove 26 in the length direction of the catching groove 26 (namely, the lead wire L of the coil traverses the catching groove 26 in the length direction of the catching groove 26 so as to be led out). Namely, the lead wire L is slopingly led out with a certain inclination in the winding direction, rather than being led out directly to a lower side from the winding unit 12. Here, as described above, the length S of the catching groove 26 is greater than the thickness D of the terminal fastening unit 30, so the lead wire L can be led out at an angle less than 45° with respect to a different order of coil (e.g., Ns4) wound in the winding unit 12. Accordingly, insulating reliability can be ensured.

Through such a configuration, as shown in FIG. 7, at least two lead wires led out through the single catching groove 26 may be disposed to cross in an X form within the single catching groove 26.

Also, as the coils Np1-Ns4 according to the present embodiment, general insulated coils (e.g., polyurethane wire) or a stranded type coil formed by twisting several strands of wires (e.g., Litz wire, etc.) may be used. Also, a multi-insulated wire (e.g., triple insulated wire (TIW), etc.) having high insulating characteristics, or the like, may be selectively used as necessary.

In particular, in the transformer 100 according to the present embodiment, the entirety (or a portion) of the individual coils are configured as multi-insulated wires, and thus, insulating characteristics can be ensured between the individual coils. Thus, the insulating tape used to insulate the coils in the related art transformer can be omitted.

The multi-insulated wire is a coil formed by forming several layers (e.g., three layers) of insulators on outside of a conductor to have increased insulating characteristics, and the use of triple insulated coil 51*b* can easily secure insulating characteristics between the conductor and the outside, minimizing the insulating distance between coils. However, the multi-insulated wire incurs high fabrication costs in comparison to the general insulated coil (e.g., a polyurethane wire).

Thus, in order to minimize fabrication costs and shorten the fabrication process, the multi-insulated coil may be used only as any one of the primary coil 51 and the secondary coil 52 in the transformer according to an embodiment of the present invention.

With reference back to FIG. 6A, the transformer 100 according to the present embodiment employs the primary coil 51 as a multi-insulated coil. In this case, the multi-insulated coil as the primary coil 51 may be stacked in the winding unit 12 and disposed at the innermost and outermost edges of the wound coils 50.

When the multi-insulated coil is disposed at the innermost and outermost edges of the wound coils 50, the multi-insulated coil as the primary coil 51 serves as an insulating layer between the secondary coil 52 as a general insulated coil and the outside. Accordingly, insulating characteristics between the outside and the secondary coil 52 can be easily secured.

Meanwhile, in the present embodiment, the case in which the multi-insulated coil as the primary coil 51 is disposed at both the innermost and outermost edges of the coils 50 is taken as an example, but the present invention is not limited thereto. Namely, the multi-insulated coil may be selectively disposed only at one of the inner side and outer side as necessary.

Figure 8:
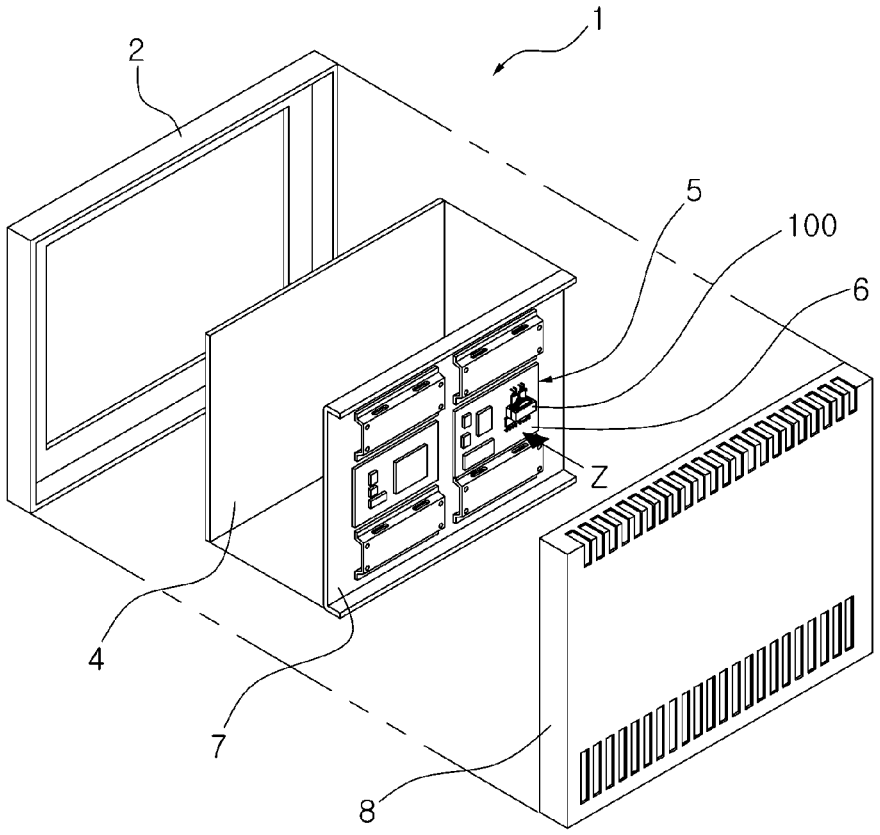
FIG. 8 is an exploded perspective view schematically illustrating a flat display device according to an embodiment of the present invention.

FIG. 8 is an exploded perspective view schematically illustrating a flat display device according to an embodiment of the present invention.

With reference to FIG. 8, a flat display device 1 may include a display panel 4, a power module 5 with the transformer 100 mounted thereon, and covers 2 and 8.

The covers 2 and 8 include a front cover 2 and a back cover 8. The front cover 2 and the back cover 8 may be coupled to form an internal space therein.

The display panel 4 is disposed in the internal space formed by the covers 2 and 8. As the display panel 4, various flat display panels such as a liquid crystal display (LCD), a plasma display panel (PDP), an organic light emitting diode (OLED), and the like, may be used.

The power module (or SMPS) 5 provides power to the display panel 4. The power module 5 may be formed by mounting a plurality of electronic components on a substrate 6, and in particular, the transformer 100 may be mounted thereon.

The power module 5 may be fixed to a chassis 7 and may be fixedly disposed along with the display panel 4 within the internal space formed by the covers 2 and 8.

Here, in the transformer 100 mounted on the power module 5, the coil (50 in FIG. 1) is wound in a direction parallel to the substrate 6. Also, when viewed from the plane of the substrate 6 (i.e., in a Z direction in FIG. 8), the coil 50 is wound in a clockwise direction or counterclockwise direction. Accordingly, a portion (i.e., an upper surface) of the core 40 is provided in parallel to the back cover 8, forming a magnetic path.

Accordingly, in the transformer 100 according to the present embodiment, as for magnetic flux formed between the back cover 8 and the transformer 100 and included in a magnetic field generated by the coil 50, since a magnetic path is mostly formed within the core 40, a generation of a leakage magnetic flux between the back cover 8 and the transformer 100 can be minimized.

Thus, in the transformer 100 according to the present embodiment, although a shielding device (e.g., a shielding unit, or the like) is not employed at an outer side of the transformer 100, vibration of the back cover 8 caused by interference between leakage magnetic flux of the transformer 100 and the back cover 8 made of a metallic material can be prevented.

Thus, when the transformer 100 is mounted in a thin electronic device such as the flat display device 1 to make the space between the back cover 8 and the transformer 100 very narrow, a generation of noise due to vibration of the back cover 8 can be prevented.

As set forth above, in the transformer according to an embodiment of the present invention configured as described above, the winding space of the bobbin is uniformly divided into a plurality of partitioned spaces, and the respective individual coils are uniformly distributed and wound in the partitioned winding spaces. Also, the respective individual coils are wound in a stacked manner. Thus, individual coils can be prevented from being inclined to one side or non-uniformly separated to be wound within the winding unit 12, and thus, leakage inductance generated as coils are irregularly wound can be minimized.

Also, in the transformer according to an embodiment of the present invention, a multi-insulated wire may be used as at least any one of a primary coil and a secondary coil. In this case, insulation between the primary coil and the secondary coil can be secured by the high insulating characteristics of the multi-insulated wire without having to use an insulating member (e.g., an insulating tape).

Thus, the insulating tape interposed between the primary coil and the secondary coil in the related art can be omitted, and since a process of attaching the insulating tape is omitted, fabrication costs and fabrication time can be reduced.

Also, the transformer is configured to fit an automated fabrication method. In detail the transformer according to an embodiment of the present invention can omit the related art insulating tape wound to be interposed between the coils through a manual operation.

In the related art using insulating tape, coils are wound around a bobbin, insulating tape is attached through a manual operation, and then, the coils are wound again, and this process is repeatedly performed. Thus, a great amount of fabrication time is required and a large amount of costs are incurred.

However, in the transformer according to an embodiment of the present invention, the process of attaching an insulating tape is omitted, so individual coils can be continuously wound in a stacked manner on a bobbin through automated winding equipment. Thus, costs and time required for fabrication can be significantly reduced.

Also, in the transformer according to an embodiment of the present invention, the primary coil and the secondary coil are connected to external connection terminals through different paths (e.g., a skip groove, a withdrawal opening, etc.). Also, the width T of the winding space is less than 0.45 times the diameter W of the winding space.

Thus, although an insulting member is omitted between the primary coil and the secondary coil, the primary coil and the secondary coil can be prevented from intersecting at an angle of 45° or more, securing insulating reliability.

In addition, the lead wires of the coil according to an embodiment of the present invention are led out along a tangent direction of the coils wound in the winding space and led out in a manner of traversing the catching groove in a length direction of the stopping opening.

Thus, since the lead wires are led out at an angle less than 45° with respect to the coils wound in the winding unit 12, insulating reliability can be secured.

The transformer according to embodiments of the present invention is not limited to the foregoing embodiments but may be variably modified. For example, in the foregoing embodiment, the flange portion and the partition wall of the bobbin are formed to have a circular shape, but the present invention is not limited thereto and the flange portion and the partition wall of the bobbin may be configured to have various shapes, such as a polygonal shape, an oval shape, or the like, as necessary.

Also, in the foregoing embodiment, the body portion of the bobbin has a circular section, but the present invention is not limited thereto and the body portion of the bobbin may be variably applicable. For example, the body portion of the bobbin may have an oval or polygonal section, or the like.

Also, in the foregoing embodiment, the terminal fastening unit is formed on a lower flange portion, but the present invention is not limited thereto and the terminal fastening unit may be variably applicable. For example, the terminal fastening unit may be formed on an upper flange portion.

Also, in the foregoing embodiment, the withdrawal opening and the catching groove are formed together in the terminal fastening unit. However, the present invention is not limited thereto and the withdrawal opening and the catching groove may be variably applicable. For example, only the catching groove may be formed, or the withdrawal opening and the catching groove may be independently formed.

Also, in the foregoing embodiments, the insulating type switching transformer is illustrated as an example, but the present invention is not limited thereto and may be extensively applied to a transformer, a coil component, an electronic device in which a plurality of coils are wound.

While the present invention has been shown and described in connection with the embodiments, it will be apparent to those skilled in the art that modifications and variations can be made without departing from the spirit and scope of the invention as defined by the appended claims.

What is claimed is:

1. A transformer comprising:

a winding unit having at least one winding space in which a plurality of coils are wound in a stacked manner on an outer circumferential surface of a cylindrical body portion; and a terminal fastening unit formed to extend from one end of the winding unit in an outer diameter direction and having a plurality of external connection terminals fastened to an end thereof, wherein a width of the winding space is less than 0.45 times a diameter of the body portion, and wherein the coils comprise a primary coil and a secondary coil, wound in a stacked manner, and when the primary coil and the secondary coil are in contact within the winding space, an angle of intersection between the primary coil and the secondary coil is less than 45°.

2. The transformer of claim 1, wherein the winding space of the winding unit is divided into a plurality of partitioned winding spaces by at least one partition wall formed on the outer circumferential surface of the body portion, and the partitioned winding spaces have a width less than or equal to 0.45 times the diameter of the body portion, respectively.

3. The transformer of claim 2, wherein a total width of the partitioned winding spaces of the winding unit is less than or equal to 0.57 times the diameter of the body portion.

4. The transformer of claim 2, wherein a length of the body portion is less than or equal to 0.57 times the diameter of the body portion.

5. The transformer of claim 2, wherein the partition wall has at least one skip groove, and the coils skip the partition wall via the skip groove so as to be evenly wound in the respective winding spaces.

6. The transformer of claim 2, wherein at least two skip grooves are formed to be spaced apart from one another, and the coils pass over or pass through the different skip grooves according to their order, respectively.

7. The transformer of claim 1, wherein the terminal fastening unit has at least one withdrawal opening, and the coils are led out to a lower side of the terminal fastening unit through the withdrawal opening.

8. The transformer of claim 7, wherein at least two withdrawal openings are formed to be spaced apart from one another, and the coils are led out through the different withdrawal openings according to their order, respectively.

9. The transformer of claim 1, wherein the terminal fastening unit comprises at least one catching groove formed in a direction in which the coils wound in the winding space are led out, and lead wires of the coils are led out by traversing the catching groove in a length direction of the stopping opening.

10. The transformer of claim 9, wherein the catching groove is formed in a tangent direction with respect to an outer surface formed by the coils wound in the winding space.

11. The transformer of claim 1, wherein the lead wires of the coils led out to the terminal fastening unit are led out in the tangent direction with respect to the outer surface formed by the coils wound in the winding space.

12. The transformer of claim 1, wherein at least one of the primary coil and the secondary coil is a multi-insulated coil.

13. A transformer comprising:

a plurality of partitioned winding spaces formed by a cylindrical body portion and flange portions formed at both ends thereof; and a plurality of coils wound in a stacked manner in the winding spaces, wherein a size of the partitioned winding spaces satisfies a conditional expression below:

$$T_a \leq 0.57 W_b \quad \text{(Conditional expression)}$$

wherein $T_a$ is a width of the entire winding space and $W_b$ is a diameter of the body portion, and wherein the coils comprise a primary coil and a secondary coil, wound in a stacked manner, and when the primary coil and the secondary coil are in contact within the winding space, an angle of intersection between the primary coil and the secondary coil is less than 45°.

14. The transformer of claim 13, wherein the size of each of the partitioned winding spaces satisfies a conditional expression below:

$$T_s \leq 0.45 W_b \quad \text{(Conditional expression)}$$

wherein $T_s$ is a width of each winding space and $W_b$ is a diameter of the body portion.

15. A power module comprising:

a transformer in which coils are wound in a stacked manner in at least one winding space formed by a cylindrical body portion and flange portions formed at both ends thereof; and a substrate on which the transformer is mounted, wherein a width of the at least one winding space is less than 0.4 times a diameter formed by an outer circumferential surface of the coil wound at the innermost portion of the body portion, and wherein the coils comprise a primary coil and a secondary coil, wound in a stacked manner, and when the primary coil and the secondary coil are in contact within the winding space, an angle of intersection between the primary coil and the secondary coil is less than 45°.

* * * * *